US011039699B1

(12) United States Patent
Leach

(10) Patent No.: US 11,039,699 B1
(45) Date of Patent: Jun. 22, 2021

(54) THERAPEUTIC PILLOW ASSEMBLY

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 1064 days.

(21) Appl. No.: 15/205,289

(22) Filed: Jul. 8, 2016

Related U.S. Application Data

(60) Provisional application No. 62/221,817, filed on Sep. 22, 2015.

(51) Int. Cl.
*A47G 9/10* (2006.01)
*A47G 9/00* (2006.01)
*A47C 20/02* (2006.01)

(52) U.S. Cl.
CPC .... *A47G 9/1072* (2013.01); *A47G 2009/1018* (2013.01)

(58) Field of Classification Search
CPC ..... A47C 20/025; A47C 20/027; A47C 7/425; A47C 27/086
See application file for complete search history.

(56) References Cited

U.S. PATENT DOCUMENTS 3,633,227 A * 1/1972 Tegeler ..... A47G 9/086 5/413 R
4,154,323 A * 5/1979 Sneider ..... A45C 9/00 190/2
5,099,530 A * 3/1992 Scott ..... A47G 9/02 5/419
6,704,953 B2 * 3/2004 Fishman ..... A47G 9/083 5/413 R
6,802,092 B1 * 10/2004 Klein ..... A47G 9/062 5/417
7,353,552 B2 * 4/2008 Leach ..... A47C 20/021 5/632
8,136,186 B1 * 3/2012 Leach ..... A47C 20/025 5/631
8,239,987 B2 * 8/2012 Sharp ..... A47C 7/383 5/636
8,448,275 B1 * 5/2013 Leach ..... A47C 20/027 297/284.5
8,671,480 B1 * 3/2014 Leach ..... A47C 20/025 5/630
8,960,509 B2 * 2/2015 Rathbun ..... A45C 3/004 224/153
2005/0278864 A1 * 12/2005 Leach ..... A47C 20/021 5/732

(Continued)

*Primary Examiner* — Peter M. Cuomo
*Assistant Examiner* — Ifeolu A Adeboyejo
(74) *Attorney, Agent, or Firm* — Mary M. Lee

(57) ABSTRACT

A therapeutic pillow comprising a body pillow and a tilt pillow. The body pillow may be U-shaped with outwardly curved arms that define a body receiving space. The center or main section of the body pillow has an outer edge along which the tilt pillow is attached at a hinge. The hinge permits the tilt pillow, which may be smaller and fan-shaped, to pivot through a range of positions. The tilt pillow may be folded over onto the top of the body pillow or back under the bottom of the body pillow or to an intermediate angled position anywhere in between. Both the pillows may comprise a pillow insert and a removable cover. A storage pouch may be attached to the body pillow for stowing the folded cover of the tilt pillow when the insert is removed. The body pillow may also have one or more accessory pockets.

28 Claims, 10 Drawing Sheets

(56) References Cited

U.S. PATENT DOCUMENTS

| | | | | |
|---|---|---|---|---|
| 2007/0271703 | A1* | 11/2007 | Matthews Brown .. | A47D 13/08 5/636 |
| 2012/0144590 | A1* | 6/2012 | Sharp ..... | A47C 7/383 5/639 |

* cited by examiner

THERAPEUTIC PILLOW ASSEMBLY

CROSS-REFERENCE TO RELATED APPLICATIONS

This application claims the benefit of U.S. provisional application No. 62/221,817 entitled "Multi-Use Therapeutic Pillow," filed Sep. 22, 2015, the contents of which are incorporated herein by reference.

FIELD OF THE INVENTION

The present invention relates generally to pillows and, more particularly but without limitation, to pillows for therapeutic positioning of the head and upper body.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

DETAILED DESCRIPTION OF THE PREFERRED EMBODIMENTS

Figure 1:
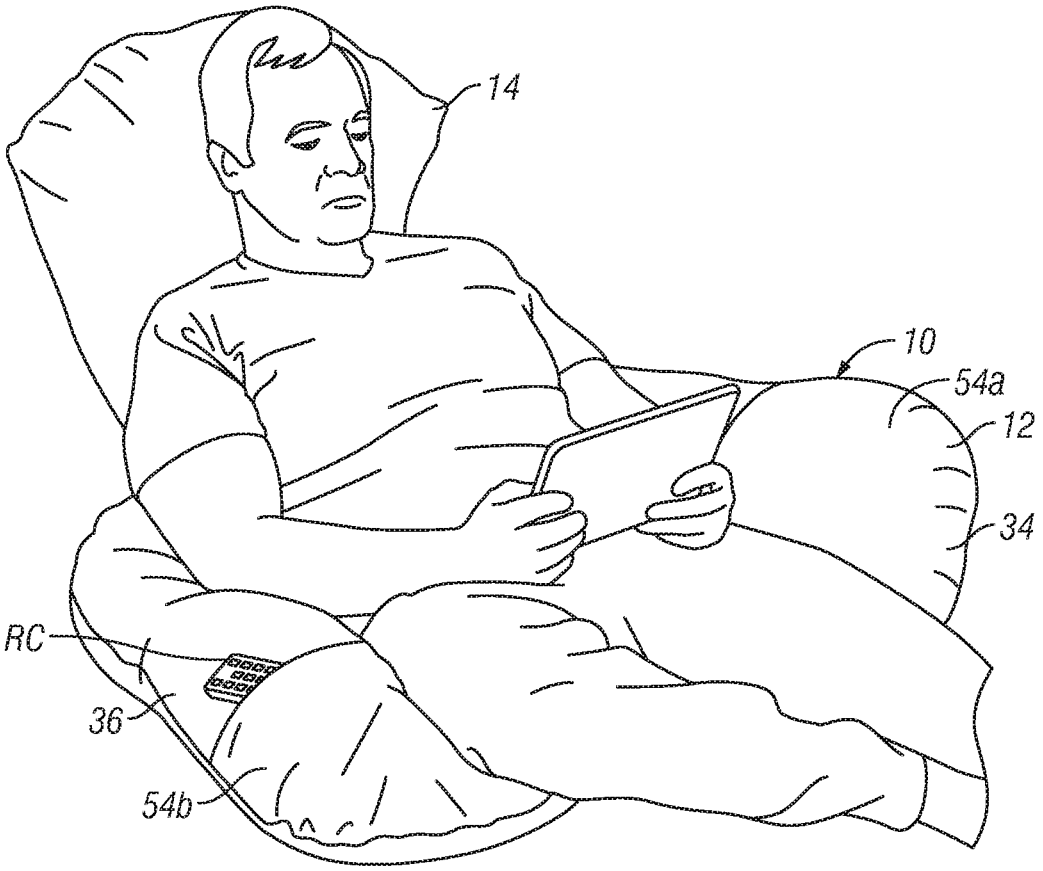
FIG. 1 is a frontal perspective view of an adult male reclining in a therapeutic pillow assembly made in accordance with a preferred embodiment of the present invention. The pillow assembly is shown with the tilt pillow angled upwardly to support the head and shoulders of the user while his arms rest on the arms of the pillow assembly.

Body pillows enjoy increasing popularity among consumers. While one major use is to provide back and belly support for expectant mothers, many others use body pillows for supporting the head and upper body while sleeping or reclining. The present invention provides a therapeutic pillow that is especially useful for alleviating the discomfort of acid reflux disease and to aid in proper positioning for persons who suffer from sleep apnea and/or are wearing CPAP (continuous positive airway pressure) masks.

Sleep apnea is caused by several different factors and requires the person suffering from it to sleep in an elevated position. Side sleeping is preferred due to the muscular relaxation that happens in sleep. Causes of sleep apnea include greater than normal relaxation of the throat and tongue muscles while sleeping. An enlarged tongue or tonsils may cause or contribute to sleep apnea. Being overweight can lead to increased thickness of the wall of the windpipe, narrowing the air passage through the windpipe. Still further, the bone structure of the head and neck may create a smaller than normal airway through the mouth and throat.

There are several risk factors associated with sleep apnea. The aging process limits the brain signals' ability to keep the throat muscles stiff during sleep. Thus, the airway is more likely to narrow or collapse. Heart disorders, such as congestive heart failure, create a greater chance of central sleep apnea. Use of narcotic pain medications, such as opioid medications, especially long-acting ones such as methadone, may increase the risk of central sleep apnea. Still further, a stroke may lead to a greater risk of central sleep apnea or treatment-emergent central sleep apnea.

Obstructive sleep apnea occurs when the muscles in the back of the throat relax. These muscles support the soft palate, the tonsils, the side walls of the throat, and the tongue. When the muscles relax, the airway narrows or closes during inhalation, leading to reduced air intake and reduced oxygen absorption. Sensing reduced oxygen in the blood, the brain triggers arousal from sleep to clear the airway. The individual may make a snorting, choking, or gasping sound. This pattern can repeat itself five to thirty times an hour, or more, throughout the night, although the episodes are so brief that the individual may have no waking memory of them. These frequent disruptions impair the ability to achieve deep, restful sleep, which in turn leads to drowsiness during waking hours.

Sleep apnea is often treated with CPAP (continuous positive airway pressure) which involves the use of an oxygen mask. The mask must be fitted snugly and is connected to an air hose. Though the application of CPAP provides relief from the symptoms of sleep apnea, the oxygen mask and hose is annoying and uncomfortable for many users.

The therapeutic pillow assembly of the present invention has a repositionable and removable tilt pillow to elevate the user's head and shoulders as needed during sleep. This may allow the user to wear the CPAP device without making any other special sleep provisions, as the tilt pillow can be folded forward or backwards, or can be removed completely, if desired. Also, because of the hinged or tilt feature, while lying on his side, the user can slip an arm under the tilt pillow when flipped forward and caress the larger U-shaped body pillow. The user can also reverse directions and place the elevated portion under the hips for other medical issues making it very versatile when elevation or other comfort positions are recommended or preferred. The tilt pillow can be completely removed when only the body pillow is needed.

Turning now to the drawings in general and to FIG. 1 in particular, there is shown therein a multi-use therapeutic pillow assembly made in accordance with a preferred embodiment of the present invention and designated generally by the reference numeral 10. The pillow assembly 10 generally comprises a first body pillow 12 and a second tilt pillow 14. FIG. 1 illustrates a user in a semi-reclining or reading position with the tilt pillow angled upwardly to support the head and shoulders of the user while his arms rest on the arms of the body pillow.

Figure 3:
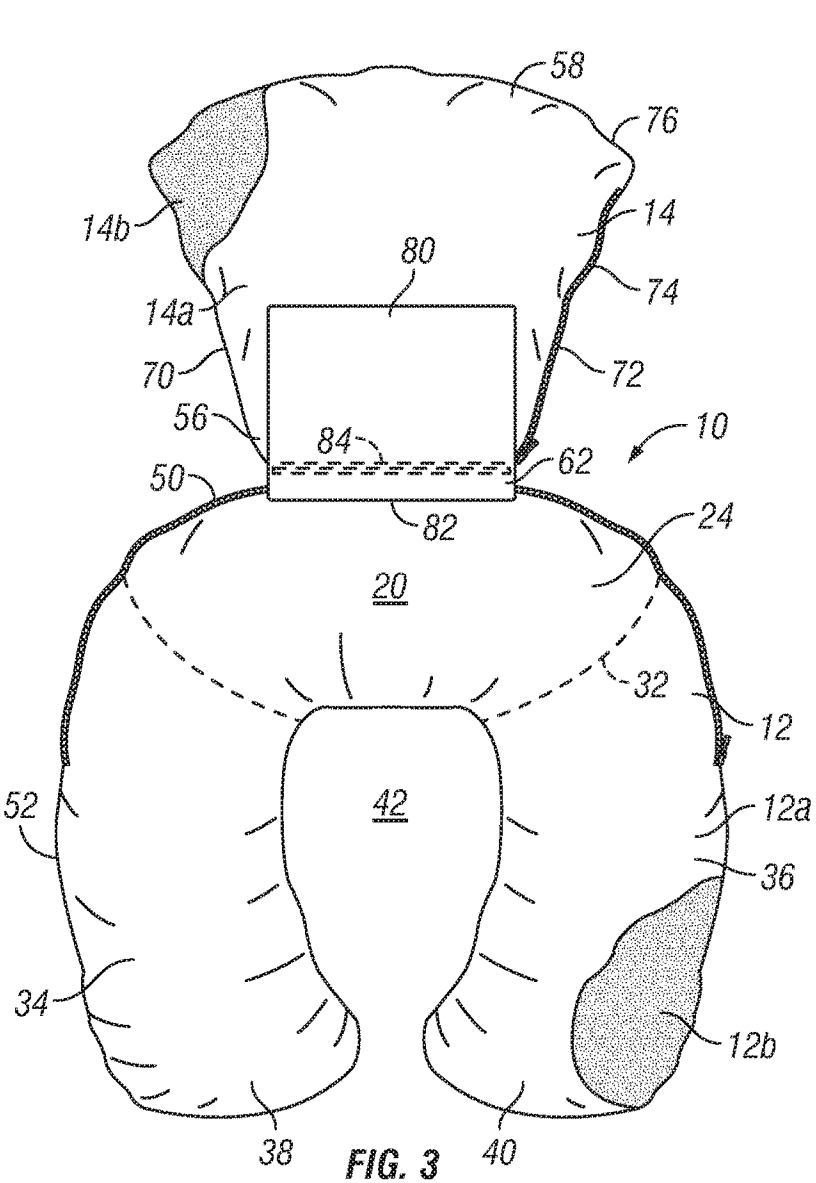
FIG. 3 is a bottom view of the pillow assembly.
Figure 2:
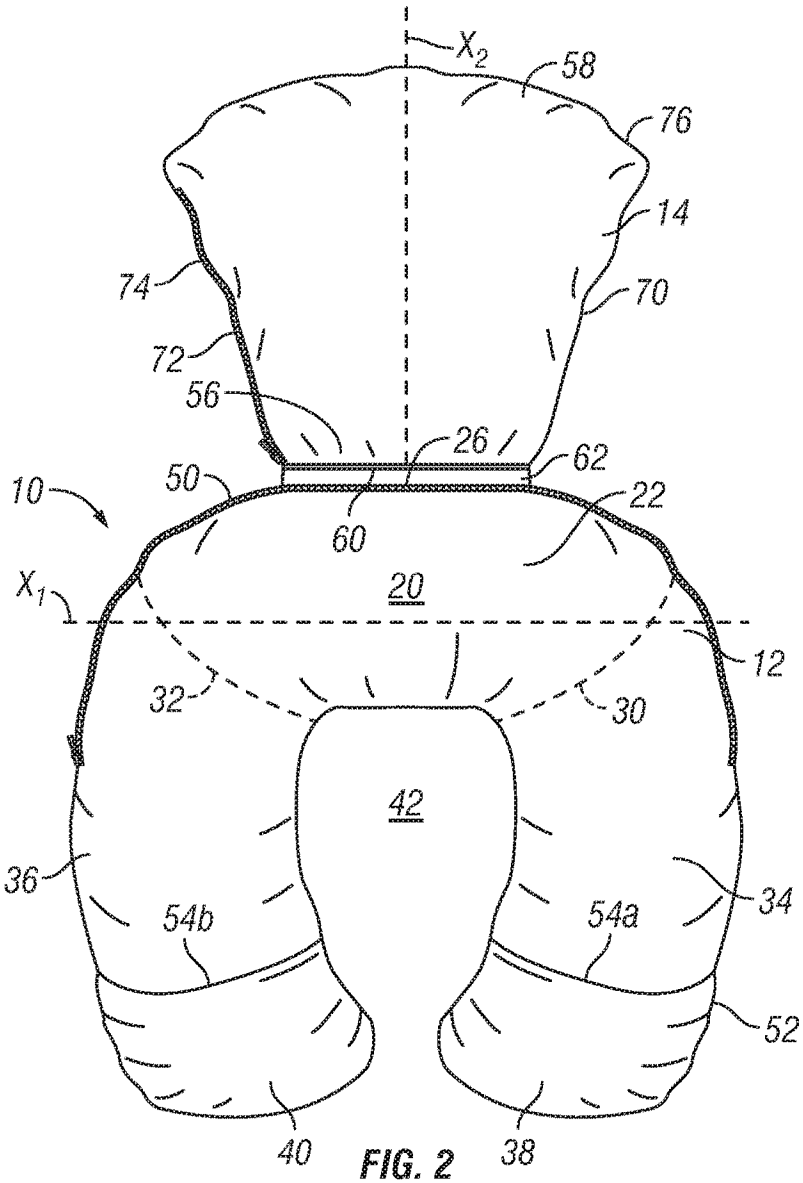
FIG. 2 is a plan view of the pillow assembly.

Referring to FIGS. 2 and 3, a most preferred embodiment of the inventive pillow assembly will be described. The first or body pillow 12 comprises a main section 20 having a top surface 22 (FIG. 2), a bottom surface 24 (FIG. 3), and an outer edge 26 between the top and bottom surfaces. The main section 20 has a first end 30 and a second end 32 and defines a longitudinal axis $X_1$ (FIG. 2) extending between the first and second ends. In this embodiment, the body pillow 12 also comprises a first arm 34 extending a distance from the first end 30 of the main section 20, and a second arm 36 extending a distance from the second end 32 of the main section. Each of the arms 34 and 36 has a free end 38 and 40, respectively. Most preferably, the first and second arms 34 and 36 are integral with or continuous with the main section 20 to provide an integrally formed body pillow. For this reason, the first and second ends 30 and 32 of the main section are indicated by dashed lines. However, the body pillow may have no arms, or may have only one arm.

With continued reference to FIGS. 2 and 3, the first and second arms 34 and 36 of the body pillow 12 extend at an angle in the same direction from the main section 20 to form a body receiving space 42. Although not essential, the first and second arms 34 and 36 may be of equal length and symmetrically shaped. More preferably, each of the first and second arms 34 and 36 may form an outward curve relative to the body receiving space 42, thereby forming a C-shaped configuration. As used herein, the term "U-shaped" encompasses a shape comprising two elongate arm forming a V or U shape when the pillow is in a resting position. As used herein, "resting position" refers to the position and shape the pillow 10 naturally assumes when no tension or pressure is exerted on any part of it. "U-shaped" does not require that the arms are the same length or that the arms are parallel. The term "C-shaped" denotes a U-shape in which the arms are curved rather than straight and is included in the meaning of the broader term "U-shaped."

Figure 5:
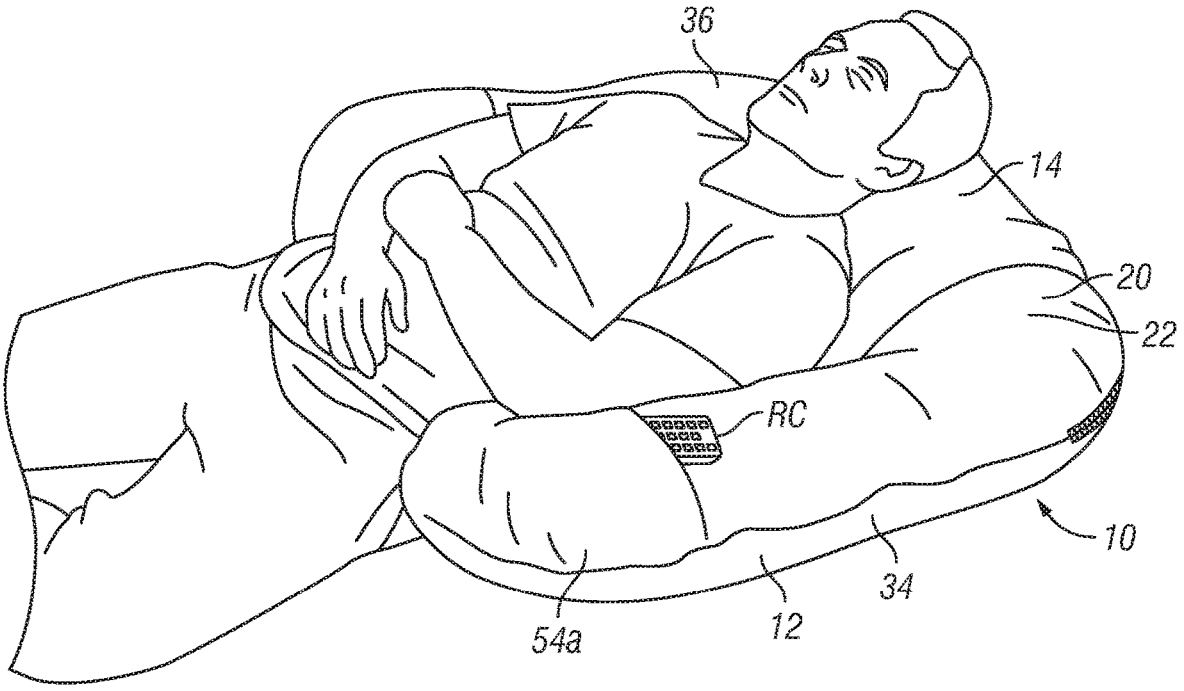
FIG. 5 is a right frontal perspective view of a user reclining in the pillow assembly configured as shown in FIG. 4 with his head resting on the tilt pillow and his upper body in the body receiving space between the pillow arms.

While the size of the body pillow 12 may vary, it is ideally sized so that, when the user is reclining in the body receiving space 42 with his head resting on the top surface 22 of the main section 20 with the top of his head adjacent the outer edge 26 of the main section and with his arms extended along the sides of his torso, as seen in FIG. 5 for example, the free ends 38 and 40 of first and second arms 34 and 36 are adjacent the user's forearms. Of course, the body pillow may be made in a range of sizes to accommodate adults and children of different heights.

The pillow assembly 12 of the present invention is amenable to various constructions. In a particularly preferred construction, the body pillow 12 comprises a cover 12*a* and a pillow insert 12*b* with the pillow cover being shaped to fittingly receive the pillow insert, as illustrated in FIG. 3. As used herein, "fittingly receive," when used in reference to the pillow covers and inserts, means that the pillow cover is sized and shaped to create an enclosure that conforms closely to the shape of the insert. While the dimensions of the enclosure formed by the cover may be slightly larger than the dimensions of the insert, to facilitate inserting the insert and removing it, the general size and shape will be the same.

Figure 7:
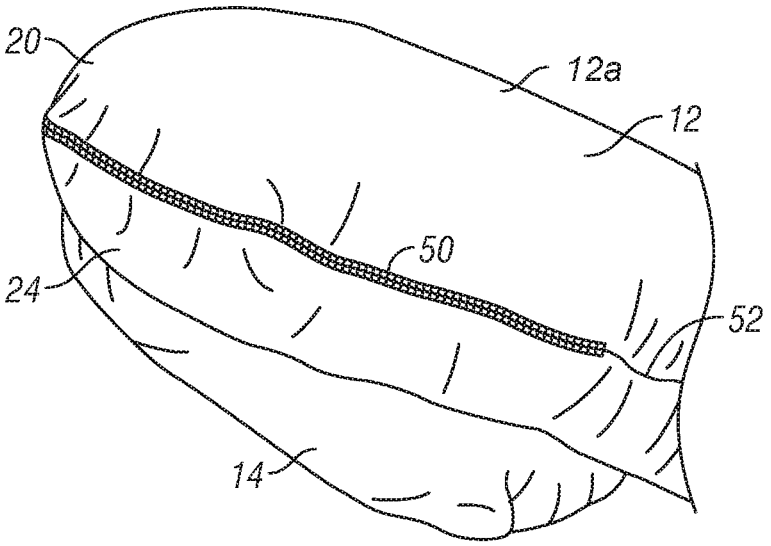
FIG. 7 is an enlarged, fragmented side view of the pillow assembly with the tilt pillow folded under the bottom surface of the main section of the body pillow.

In most instances, the cover 12*a* will include an access opening with a closure of some sort so that the cover is removable for cleaning, repair, or replacement. In the embodiment shown, a zipper 50 defines the access opening. However, any suitable closure mechanism may be used, such as hook-and-loop fasteners, or by ties, or snaps, or buttons, or hooks, and so forth. The size and position of the zipper 50 may vary. In this embodiment, the zipper 50 is positioned around the outer perimeter of the body pillow. In a simple construction, the cover 12*a* will be made by sewing together the peripheral edges of two similarly shaped fabric pieces, and the zipper 50 is conveniently located along the peripheral seam 52, as indicated in FIG. 7.

Using an additional panel of fabric, one or both of the free ends 38 and 40 may be provided with an accessory pocket 54*a* and 54*b*, as seen best in FIG. 2. The pockets 54*a* and 54*b* are convenient for holding a remote control "RC" (FIG. 1) for a television or ceiling fan, for example, an inhaler, a cell phone, or any other object that the user may want to have within arm's reach while resting. As shown and described, in the preferred embodiment, where the body pillow 12 is U-shaped, an ideal location for such pockets is on the free ends 38 and 40 of the arms 34 and 36, though the pockets 54*a* and 54*b* may be located elsewhere or eliminated entirely.

Referring still to FIGS. 2 and 3, a preferred second or tilt pillow 14 will be explained. The specific size and shape of the tilt pillow 14 may vary. However, in a particularly preferred embodiment, the tilt pillow 14 is fan-shaped. Alternately, the tilt pillow 14 may be differently shaped, such as round, oval, triangular, rectangular, trapezoidal, or diamond shaped, among others.

The tilt pillow 14 has first and second ends 56 and 58 and an attachment edge 60 (FIG. 2) along the first end. Thus, the second pillow 14 defines a longitudinal axis $X_2$ (FIG. 2) extending between the first and second ends 56 and 58. The attachment edge 60 is joined to the outer edge 26 of the main section 20 of the first pillow 12 at a joint, designated generally at 62.

Now it will be seen that the longitudinal axis $X_2$ of the second pillow 14 is perpendicular to the longitudinal axis $X_1$ of the main section 20 of the first pillow 12, and that the second pillow is movable pivotally about the joint 62 to a range of positions relative to the main section of the first pillow. The range of positions includes a first position and a second position. In the first position, seen in FIG. 4, the tilt pillow 14 is positioned on the top surface 22 of the main section 20 of the body pillow 12, and in the second position, seen in FIG. 7, the tilt pillow is positioned under the bottom surface 24 of the main section of the body pillow.

With continuing reference to FIGS. 2 and 3, the tilt pillow 14 further comprises first and second side edges 70 and 72 extending between the first and second ends 56 and 58. To form a desired fan shape, the first and second side edges 70 and 72 may be straight and may diverge from the first end 56 of the tilt pillow, and the second end 58 may define an outwardly curved edge.

As with the body pillow 12, the tilt pillow 14 comprises a removable cover 14*a* and a pillow insert 14*b*, with the pillow cover being shaped to fittingly receive the pillow insert. As before, "fittingly receive," when used in reference to the pillow covers and inserts, means that the pillow cover is sized and shaped to create an enclosure that conforms closely to the shape of the insert. While the dimensions of the enclosure formed by the cover may be slightly larger than dimensions of the insert, to facilitate inserting the insert and removing it, the general size and shape will be the same.

In most instances, the cover 14*a* will include an access opening with a closure of some sort so that the cover is removable for cleaning, repair or replacement. In the embodiment shown, a zipper 74 defines the access opening. However, any suitable closure mechanism may be used, such as hook-and-loop fasteners, or by ties, or snaps, or buttons, or hooks, and so forth. The size and position of the zipper 74 may vary. In this embodiment, the zipper 74 is positioned along one of the first and second side edges 70 and 72, such as the side edge 70. In a simple construction, the cover 14*a* will be made by sewing the peripheral edges of two similarly shaped fabric pieces, and the zipper 74 may be conveniently located in the peripheral seam 76.

For optimum versatility, the tilt pillow insert 14*b* may be removable. To that end, pillow assembly 10 may further comprise a storage pouch 80. The location of the pouch 80 may vary, but it is advantageous to attach the pouch to the body pillow 12 and more preferably to the body pillow cover 12*a*. The size and shape of the pouch 80 may vary, but it may be a simple rectangular compartment having an attachment edge 82 (FIG. 3) sewn into the seam 52 of body pillow cover 12*a* and adjacent the hinge 62. The pouch 80 is sized to receive the pillow cover 14*a* of the tilt pillow 14 when the tilt pillow insert 12*b* is removed and the pillow cover 12*a* is collapsed into a folded or rolled configuration, as will be explained hereafter.

In the embodiment shown, a zipper 84 (see also FIG. 9G) defines the access opening. However, any suitable closure mechanism may be used, such as hook-and-loop fasteners, or by ties, or snaps, or buttons, or hooks, and so forth. The size and position of the zipper 84 may vary. In the exemplary embodiment, the zipper 84 extends along the inside surface of the pouch 80, as described in more detail below. In the most preferred practice of this invention, it is desirable to attach the attachment edge 82 of the pouch 80 with the first end of the pillow cover 14*b* together inside the seam 52 of the body pillow cover 12*a*, as this facilitates insertion of the tilt pillow cover 14*a* inside the pouch 80, as will become apparent.

Each of the pillow inserts 12*b* and 14*b* comprises compressible, resilient material. In a preferred embodiment, each of the inserts 12*b* and 14*b* comprises a fabric enclosure (not shown) filled with a compressible, resilient material. The fabric enclosure material may be any suitable fabric, including but not limited to waterproof nylon, flannel, muslin, or elastic fabrics, such as spandex or cotton-spandex blends. Presently, a polyester/cotton blend is preferred. The compressible, resilient material may be solid or loose. For example, a preferred loose filler is polyester fiberfill. Other suitable fillers include down feathers, memory foam, polystyrene pellets. In some instances, the inserts 12*b* and 14*b* may comprise inflatable bladders or solid foam carved to the desired shape.

Most preferably, the pillow cover assembly—the body pillow cover 12*a*, the tilt pillow cover 14*a*, and the pouch 80—is unitary, that is, all these components are permanently attached to each other as by stitching. This prevents one of the components from becoming separated and lost.

Having described the preferred embodiment of the pillow assembly 10, its use now will be described with reference to FIGS. 1 and 4-10. FIG. 1 illustrates a user in a reading or study position. The user is in a semi-reclining position with his lower body in the body receiving space 42 of the body pillow 12 and his head and shoulders leaning back on the tilt pillow 14, which is in an angled position. The pillow assembly 10 in this arrangement typically will be used in bed or on another flat surface that has an adjacent vertical surface (not show), such as a headboard or wall to support the tilt pillow 14.

Figure 4:
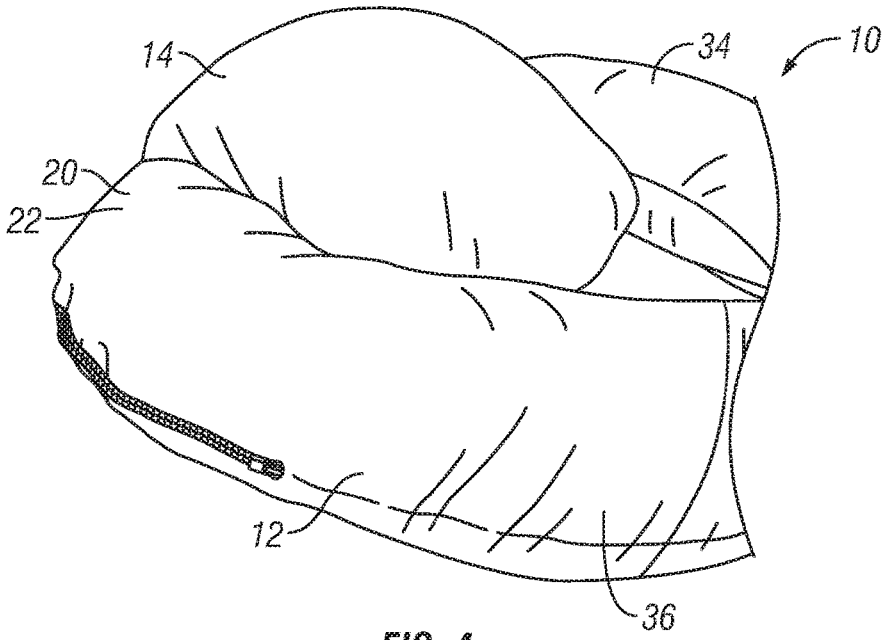
FIG. 4 is a right side perspective view of the pillow with the tilt pillow folded forward and resting on the top surface of the main section of the body pillow.
Figure 6:
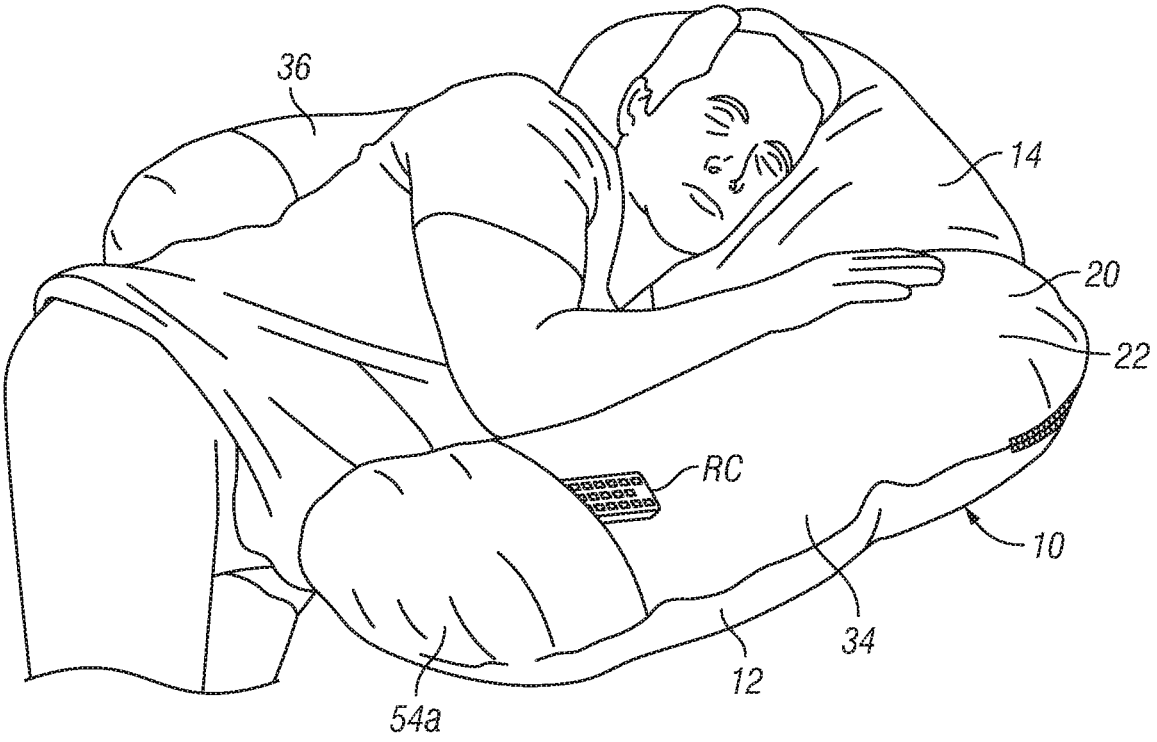
FIG. 6 is a right frontal perspective view of a user lying on his left side in the pillow assembly configured as shown in FIG. 4 with his head resting on the tilt pillow and his upper body in the body receiving space between the pillow arms.

Another beneficial position for the pillow assembly 10 is shown in FIGS. 4-6. In this position, the tilt pillow 14 is folded over onto the top surface 22 of the main section 20 of the body pillow 12. This position provides a double pillow for the users head. The user may enjoy this position when lying in a supine position, as seen in FIG. 5, or when side-lying, as seen in FIG. 6.

Figure 8:
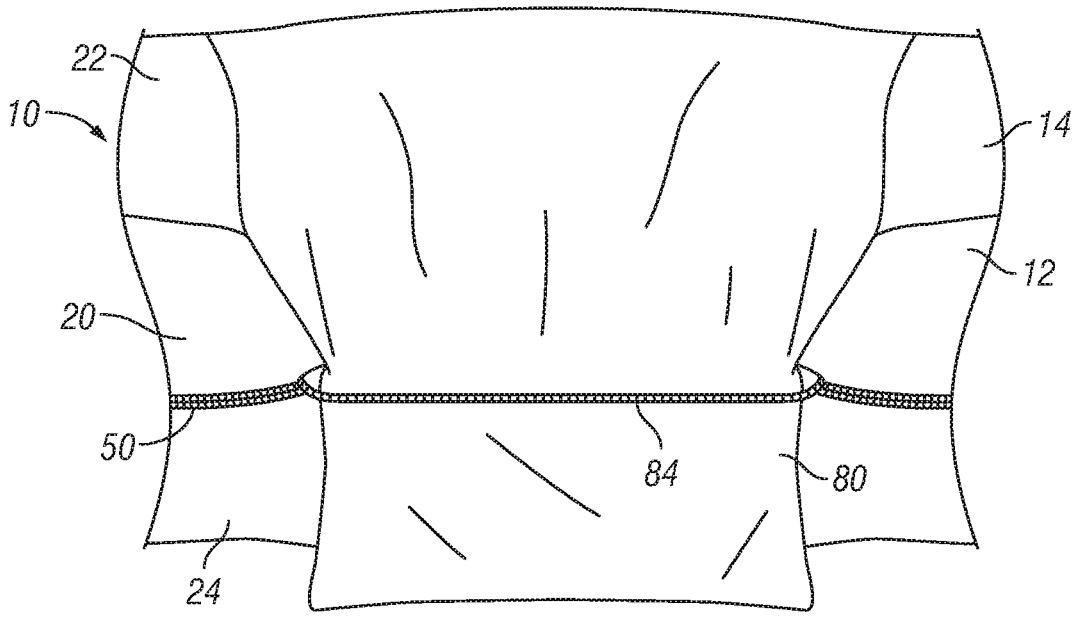
FIG. 8 is a rear view of the pillow assembly with the tilt pillow folded forward and resting on the top surface of the main section of the body pillow, as shown in FIG. 4, and illustrating the storage pouch for the tilt pillow.

FIGS. 7 and 8 illustrates yet another position, in which the tilt pillow 14 is folder underneath the bottom surface 24 of the main section 20 of the body pillow 12. This position also provides a double pillow for the users head. The user may enjoy this position when lying in a supine position or when side-lying. FIG. 8 illustrates the position of the pouch 80 when the pillow assembly 10 is in this configuration.

Figure 9A:
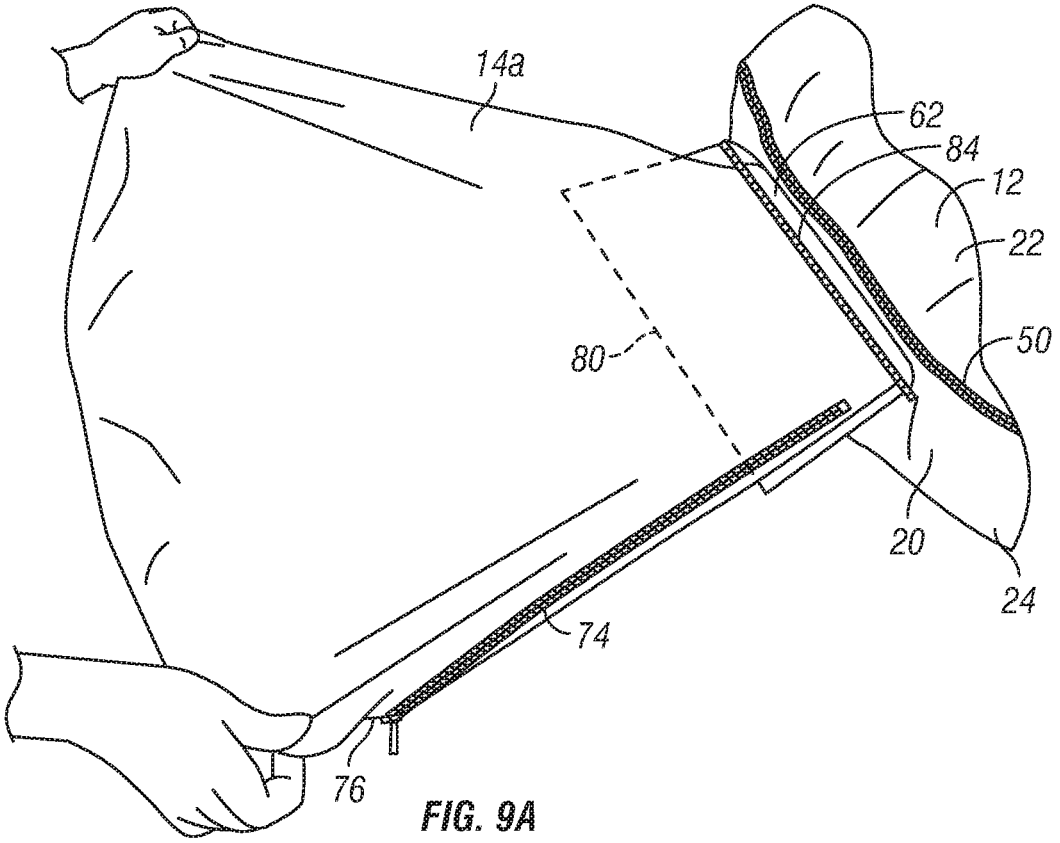
FIG. 9A is a rear perspective view of the pillow assembly illustrating the first step in the process of stowing the emptied pillow cover of the tilt pillow. The pillow insert has been removed and the cover is spread out in preparation for folding.
Figure 9B:
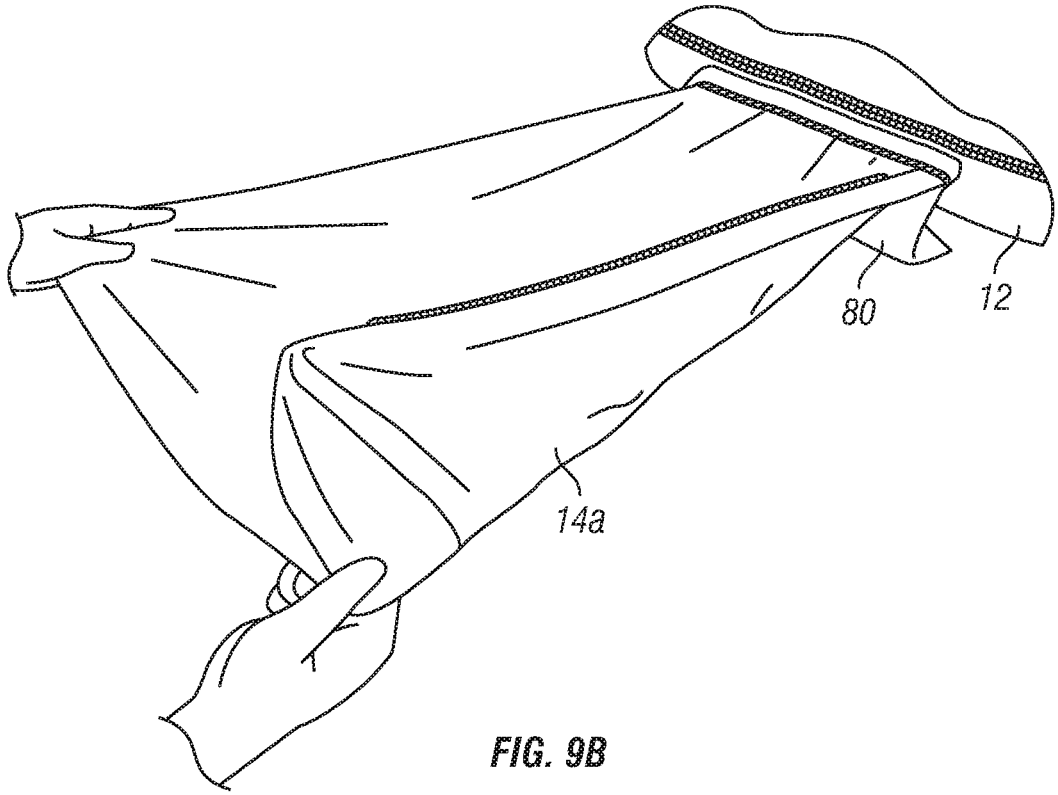
FIG. 9B is a rear perspective view of the pillow assembly illustrating the second step in the process of stowing the emptied pillow cover of the tilt pillow. The right side of the pillow cover is being folded inwardly.
Figure 9C:
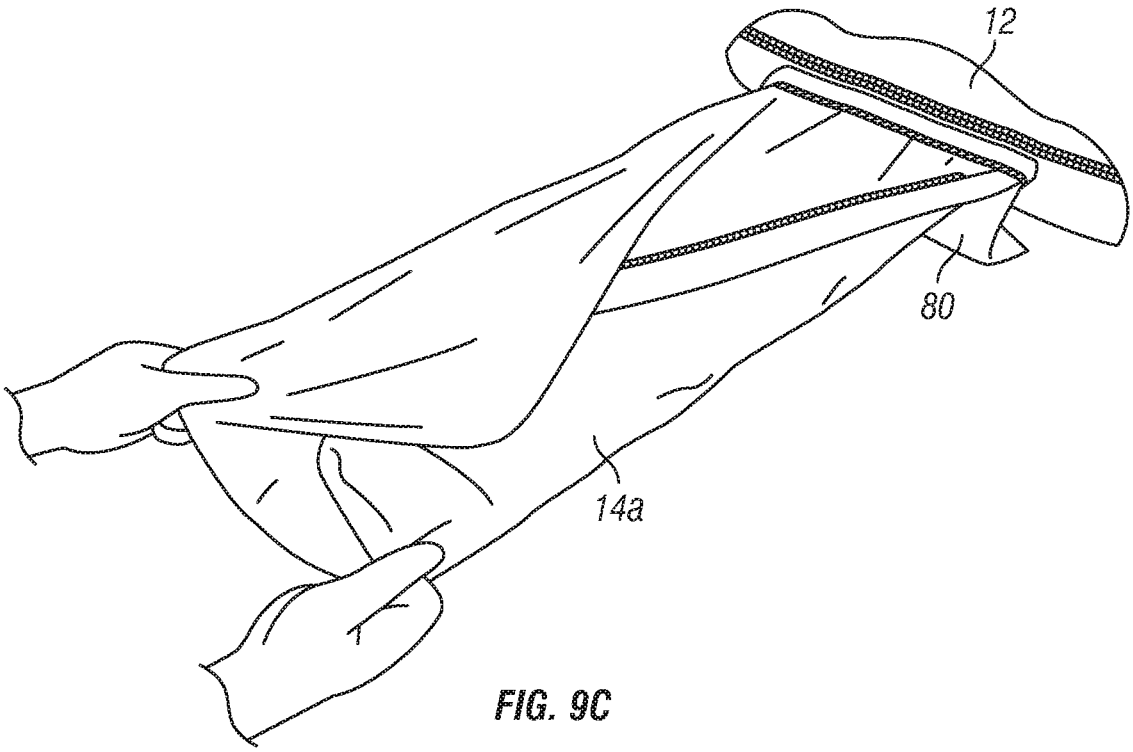
FIG. 9C is a rear perspective view of the pillow assembly illustrating the third step in the process of stowing the emptied pillow cover of the tilt pillow. The left side of the pillow cover is being folded inwardly on the right side.
Figure 9D:
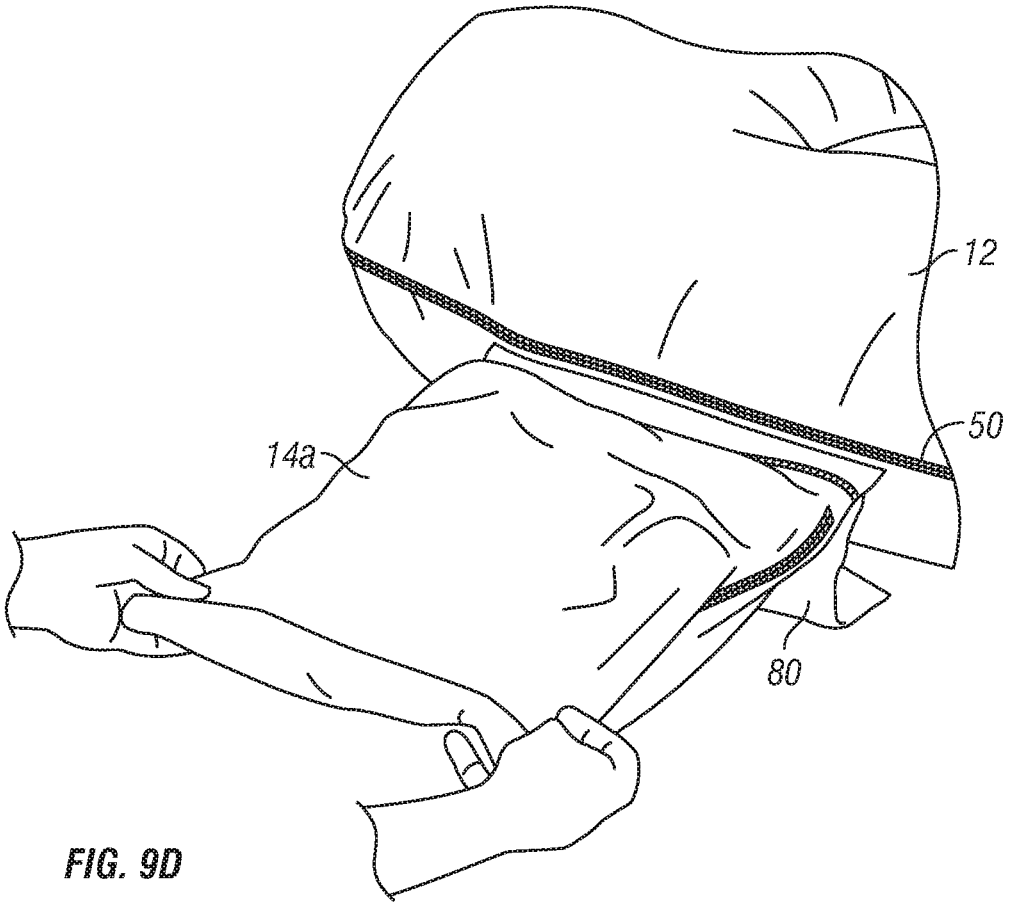
FIG. 9D is a rear perspective view of the pillow assembly illustrating the fourth step in the process of stowing the emptied pillow cover of the tilt pillow. The far end of the folded pillow cover is being folded inwardly.
Figure 9E:
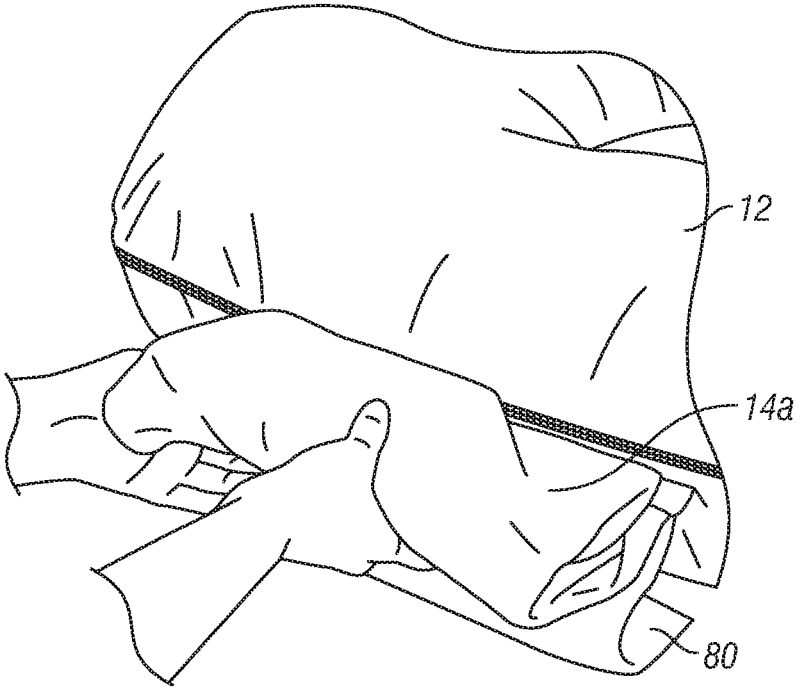
FIG. 9E is a rear perspective view of the pillow assembly illustrating the fifth step in the process of stowing the emptied pillow cover of the tilt pillow. The collapsed pillow cover is being lifted to insert it through the zippered opening in the storage pouch.
Figure 9F:
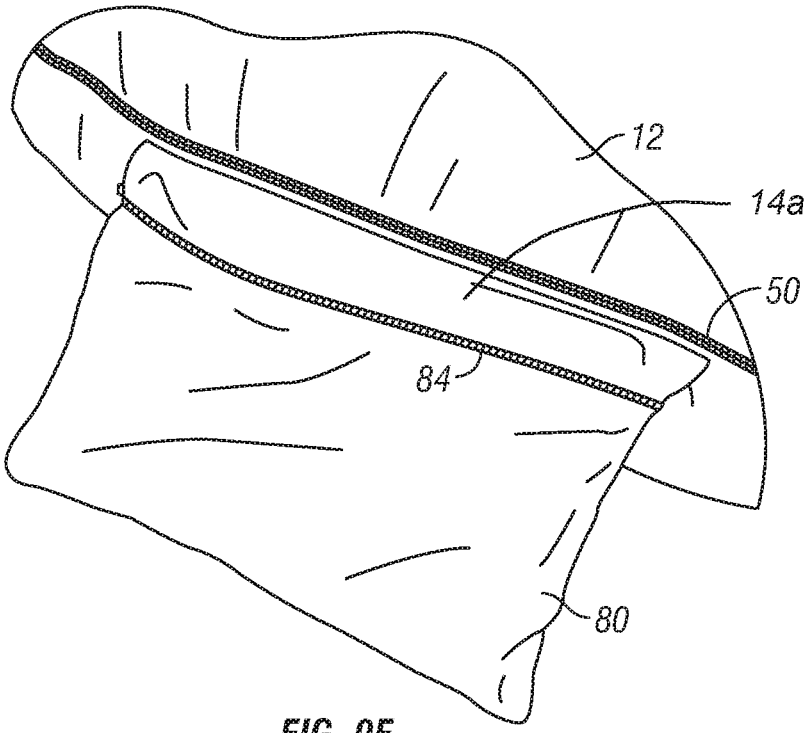
FIG. 9F is a rear perspective view of the pillow assembly showing the collapsed pillow cover almost completely enclosed in the storage pouch.
Figure 9G:
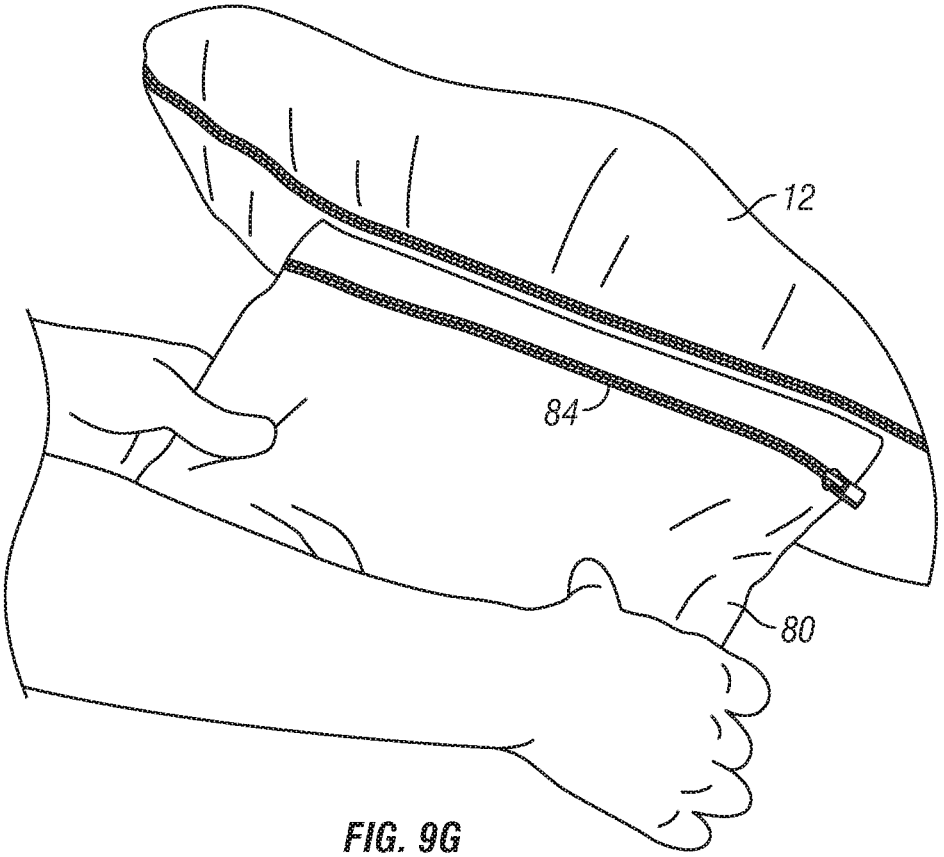
FIG. 9G is a rear perspective view of the pillow assembly showing the closed storage pouch with the folded tilt pillow cover inside.
Figure 10:
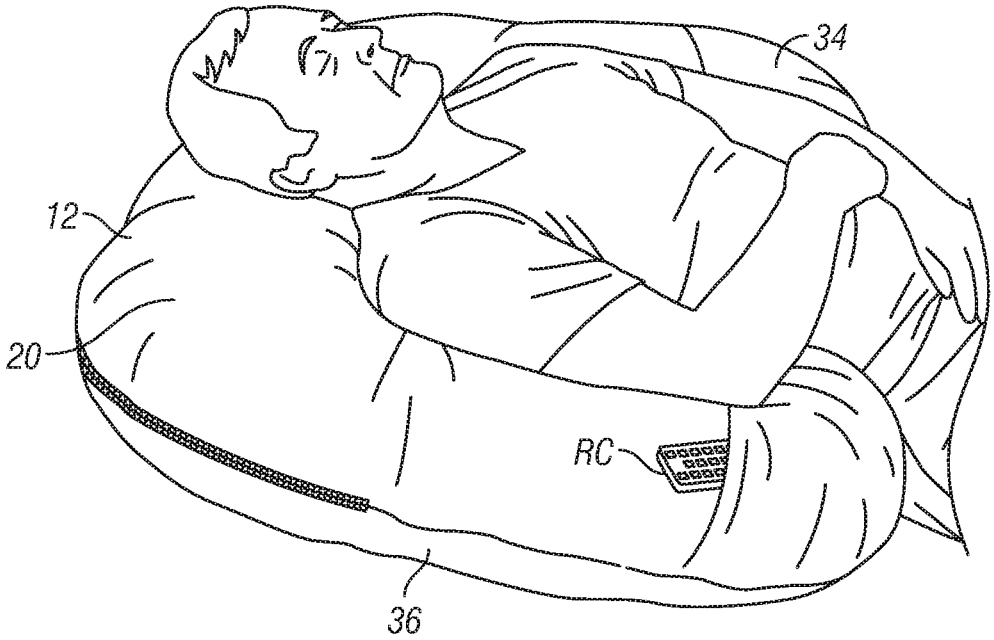
FIG. 10 is a side perspective view of a user in a back lying position on the pillow assembly with the tilt pillow insert removed and the cover pouch folded under the main section of the body pillow.

As indicated, in some cases, the user may prefer not to use the tilt pillow 14. FIGS. 9A-9G illustrate how the tilt pillow cover 14*a* can be stowed away in the pouch 80 after the pillow insert 14*b* (FIG. 3) has been removed through the zipper 74. First, as shown in FIG. 9A, the tilt pillow cover 14*a* is flattened. Then, the right side of the cover 14*a* is folded in over the center, as shown in FIG. 9B. Then, the left side of the cover 14*a* is folded in on the left side, as shown in FIG. 9C. FIG. 9D shows how the longitudinally folded cover 14*a* is then folded or rolled up into a fully collapsed position, shown in FIG. 9E. Then, the collapsed cover 14*a* is stuffed into the pouch 80 through the zipper 84. Finally, as shown in FIG. 9G, the zipper 84 is closed. FIG. 10 shows a user in a supine position with his head resting on the main section 20 of the body pillow 12.

Figure 11:
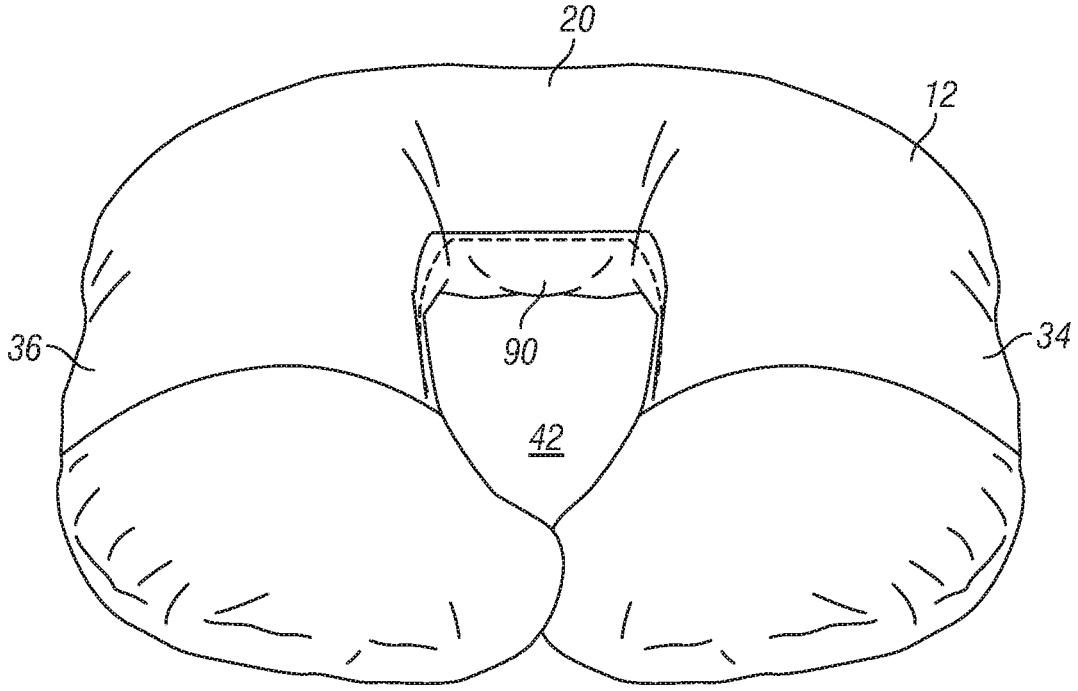
FIG. 11 is a front perspective view of the main body pillow showing the gusset panel on the inner perimeter.
Figure 12:
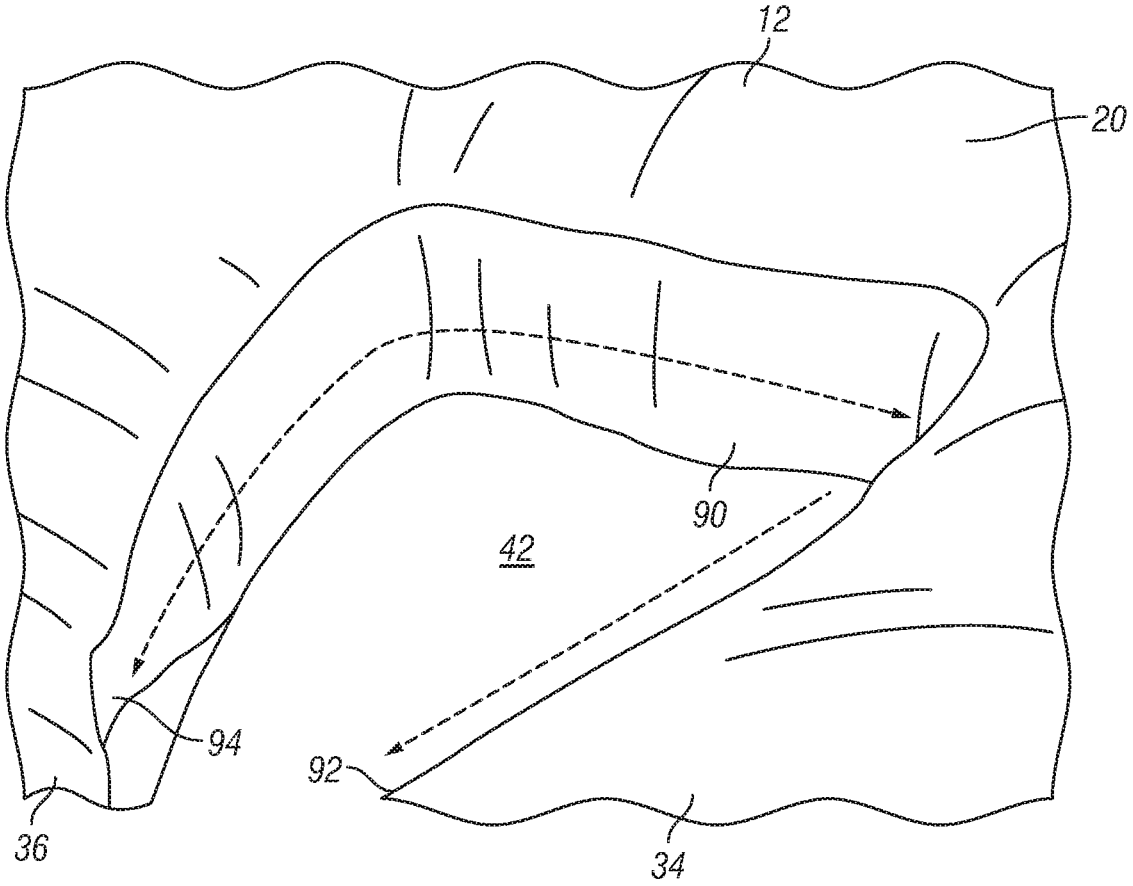
FIG. 12 is an enlarged, fragmented, perspective view of the gusset panel around the inner perimeter of the body pillow.

FIGS. 10 and 11 show an advantageous feature that may be included in the construction of the body pillow 12. Instead of simply sewing together the peripheral edges of the top and bottom fabric pieces, the inner perimeter comprising the curve portion of the body receiving space 42 may be provided with a short vertical panel or gusset 90. The ends 92 and 94 of the gusset 90 may taper to a point a distance down the inner perimeter of the arms 34 and 36. This may provide increased comfort to an individual reclining in the body receiving space, especially when in a side-lying position.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. A pillow assembly comprising:

a first pillow comprising a main section having a top surface, a bottom surface, an outer edge between the top and bottom surfaces, a first end, and a second end, and wherein the main section of the first pillow defines a longitudinal axis extending between the first and second ends; and a second pillow having first and second ends and an attachment edge along the first end, wherein the second pillow defines a longitudinal axis extending between the first and second ends, wherein the attachment edge is adjacent to and joined to the outer edge of the main section of the first pillow at a joint whereby the longitudinal axis of the second pillow is perpendicular to the longitudinal axis of the main section of the first pillow, where the second pillow is movable pivotally about the joint to a range of positions relative to the main section of the first pillow, the range of positions including a first position and a second position, wherein in the first position, the second pillow is positioned on the top of the main section of the first pillow, and wherein in the second position, the second pillow is positioned under the bottom surface of the main section of the first pillow.

2. The pillow assembly of claim 1 wherein the second pillow further comprises first and second side edges extending between the first and second ends of the second pillow.

3. The pillow assembly of claim 2 wherein the first and second side edges are straight and diverge from the first end of the second pillow.

4. The pillow assembly of claim 3 wherein the second end defines an outwardly curved edge.

5. The pillow assembly of claim 1 wherein the second pillow comprises a cover and a pillow insert, wherein the pillow cover is shaped to fittingly receive the pillow insert.

6. The pillow assembly of claim 5 further comprising a storage pouch attached to the first pillow and sized to receive the pillow cover of the second pillow when the second pillow insert is removed and the pillow cover of the second pillow is collapsed into a folded or rolled configuration.

7. The pillow assembly of claim 6 wherein the storage pouch has an attachment edge and wherein the attachment edge of the storage pouch is attached to the first pillow adjacent the hinge.

8. The pillow assembly of claim 1 wherein the first pillow further comprises a first arm extending a distance from the first end of the main section.

9. The pillow assembly of claim 8 wherein the first pillow further comprises a second arm extending a distance from the second end of the main section.

10. The pillow assembly of claim 9 wherein the first and second arms of the first pillow extend at an angle in the same direction from the main section to form a body receiving space.

11. The pillow assembly of claim 10 wherein the first and second arms are symmetrically shaped.

12. The pillow assembly of claim 11 wherein each of the first and second arms form an outward curve relative to the body receiving space.

13. The pillow assembly of claim 11 wherein each of the first and second arms has a free end and wherein at least one of the first ends includes an accessory pocket.

14. The pillow assembly of claim 11 wherein the pillow assembly is sized so that, when a user is reclining in the body receiving space with the user's head resting on the top surface of the main section of the first pillow with the top of the user's head adjacent the outer edge of the main section and with the user's arms extended along the sides of the user's torso, the free ends of first and second arms are adjacent the user's forearms.

15. The pillow assembly of claim 1 wherein the first pillow comprises a cover and a pillow insert and wherein the pillow cover of the first pillow is shaped to fittingly receive the pillow insert of the first pillow.

16. A cover assembly for a pillow assembly, the cover assembly comprising:

a first cover for a first pillow insert, wherein the first cover is configured to fittingly receive the first pillow insert, and wherein the first pillow insert comprises a main section having a top surface, a bottom surface, an outer edge between the top and bottom surfaces, a first end, and a second end, wherein the first cover has an outer edge positioned along the outer edge of the first pillow insert when the first pillow insert is received inside the first cover, and wherein the main section of the first pillow defines a longitudinal axis extending between the first and second ends; and a second cover for a second pillow insert, wherein the second cover is configured to fittingly receive the second pillow insert, wherein the first pillow insert has first and second ends, wherein the second cover includes an attachment edge positioned to extend along the first end of the second pillow insert when the second pillow insert is received inside the second cover, wherein the second pillow defines a longitudinal axis extending between the first and second ends, wherein the attachment edge of the second cover is adjacent to and joined to the outer edge of the first cover at a joint so that, when the first pillow insert is received in the first cover and the second pillow insert is received in the second cover, the longitudinal axis of the second pillow is perpendicular to the longitudinal axis of the main section of the first pillow whereby the second pillow is movable pivotally about the joint to a range of positions relative to the main section of the first pillow, the range of positions including a first position and a second position, wherein in the first position, the second pillow is positioned on the top of the main section of the first pillow, and wherein in the second position, the second pillow is positioned under the bottom surface of the main section of the first pillow.

17. The cover assembly of claim 16 wherein the second pillow further comprises first and second side edges extending between the first and second ends of the second pillow.

18. The cover assembly of claim 17 wherein the first and second side edges are straight and diverge from the first end of the second pillow.

19. The cover assembly of claim 18 wherein the second end defines an outwardly curved edge.

20. The cover assembly of claim 16 further comprising a storage pouch attached to the first cover and sized to receive the second cover when the second pillow insert is removed and the second cover is collapsed into a folded or rolled configuration.

21. The cover assembly of claim 20 wherein the storage pouch has an attachment edge and wherein the attachment edge of the storage pouch is attached to the first pillow cover adjacent the hinge.

22. The cover assembly of claim 16 wherein the first pillow insert further comprises a first arm extending a distance from the first end of the main section of the first pillow insert.

23. The cover assembly of claim 22 wherein the first pillow insert further comprises a second arm extending a distance from the second end of the main section of the first pillow insert.

24. The cover assembly of claim 23 wherein the first and second arms of the first pillow insert extend at an angle in the same direction from the main section to form a body receiving space.

25. The cover assembly of claim 24 wherein the first and second arms are symmetrically shaped.

26. The cover assembly of claim 25 wherein each of the first and second arms form an outward curve relative to the body receiving space.

27. The cover assembly of claim 25 wherein each of the first and second arms has a free end and wherein the first cover includes at least one accessory pocket positioned on the first cover to be on at least one of the first ends of the first pillow insert when the first pillow insert is received in the first cover.

28. The cover assembly of claim 25 wherein the pillow assembly cover is sized so that when the first and second pillow inserts are received inside the first and second pillow covers and when a user is reclining in the body receiving space with the user's head resting on the top surface of the main section of the first pillow with the top of the user's head adjacent the outer edge of the main section and with the user's arms extended along the sides of the user's torso, the free ends of first and second arms are adjacent the user's forearms.

* * * * *